US008477956B2

(12) United States Patent
Ura

(10) Patent No.: US 8,477,956 B2
(45) Date of Patent: Jul. 2, 2013

(54) HOWLING SUPPRESSION DEVICE, HOWLING SUPPRESSION METHOD, PROGRAM, AND INTEGRATED CIRCUIT

(75) Inventor: Takefumi Ura, Kanagawa (JP)

(73) Assignee: Panasonic Corporation, Osaka (JP)

( * ) Notice: Subject to any disclaimer, the term of this patent is extended or adjusted under 35 U.S.C. 154(b) by 324 days.

(21) Appl. No.: 12/866,090

(22) PCT Filed: Jan. 26, 2010

(86) PCT No.: PCT/JP2010/000420

§ 371 (c)(1),
(2), (4) Date: Aug. 4, 2010

(87) PCT Pub. No.: WO2010/087147

PCT Pub. Date: Aug. 5, 2010

(65) Prior Publication Data

US 2010/0329474 A1 Dec. 30, 2010

(30) Foreign Application Priority Data

Jan. 30, 2009 (JP) ..... 2009-021008

(51) Int. Cl.
*G10K 11/16* (2006.01)

(52) U.S. Cl.
USPC ..... 381/71.11; 381/26; 381/56; 381/57; 381/58; 381/59; 381/61; 381/93; 381/91; 381/92; 381/95; 381/66; 381/83; 381/71.1; 381/71.2; 379/406.1; 379/406.05; 379/406.08; 379/406.12; 379/406.13; 379/406.14

(58) Field of Classification Search
USPC ..... 381/26, 56–59, 61, 93, 91, 92, 95, 381/71.1–71.14, 94.1, 94.3, 83, 66; 379/406.1, 379/406.5, 406.8, 406.12–406.14
See application file for complete search history.

(56) References Cited

U.S. PATENT DOCUMENTS

| | | | | |
|---|---|---|---|---|
| 5,245,665 | A * | 9/1993 | Lewis et al. | 381/93 |
| 5,402,496 | A | 3/1995 | Soli et al. | |
| 7,133,529 | B2 * | 11/2006 | Ura | 381/66 |
| 7,190,800 | B2 * | 3/2007 | Terada et al. | 381/93 |

(Continued)

FOREIGN PATENT DOCUMENTS

| | | |
|---|---|---|
| JP | 5-137191 | 6/1993 |
| JP | 5-308697 | 11/1993 |

(Continued)

*Primary Examiner* — Mohammad Islam
*Assistant Examiner* — Kuassi Ganmavo
(74) *Attorney, Agent, or Firm* — Wenderoth, Lind & Ponack, L.L.P.

(57) ABSTRACT

A howling suppression device that can reduce quality deterioration of processed sound includes: a delay unit delaying the input signal to output the delayed input signal as a reference signal; a signal separation unit including an adaptive filter extracting a periodic signal component from the reference signal by adaptively updating a filter coefficient; a howling detection unit detecting an occurrence of howling using at least a signal of the periodic signal component output from the adaptive filter; and a howling suppression unit. The howling suppression unit includes: a suppression filter obtaining the updated filter coefficient from the adaptive filter with timing when the howling detection unit detects the occurrence of the howling, to extract the periodic signal component from the reference signal based on the filter coefficient; and a subtractor subtracting the periodic signal component from the input signal so as to output a signal obtained by the subtraction.

14 Claims, 10 Drawing Sheets

U.S. PATENT DOCUMENTS

| | | | | |
|---|---|---|---|---|
| 7,231,036 | B2 * | 6/2007 | Akie | 379/406.05 |
| 7,899,195 | B2 * | 3/2011 | Okumura et al. | 381/83 |
| 8,144,895 | B2 * | 3/2012 | Ura | 381/93 |
| 2002/0126855 | A1 * | 9/2002 | Terada et al. | 381/93 |
| 2003/0169892 | A1 * | 9/2003 | Ura | 381/93 |
| 2006/0095256 | A1 * | 5/2006 | Nongpiur et al. | 704/207 |
| 2007/0172080 | A1 * | 7/2007 | Janse et al. | 381/93 |
| 2009/0080674 | A1 | 3/2009 | Ura | |
| 2010/0260352 | A1 * | 10/2010 | Hoshuyama | 381/94.2 |

FOREIGN PATENT DOCUMENTS

| | | |
|---|---|---|
| JP | 6-189395 | 7/1994 |
| JP | 7-007785 | 1/1995 |
| JP | 2001-275182 | 10/2001 |
| JP | 2001-285986 | 10/2001 |
| JP | 2004-200883 | 7/2004 |
| WO | 2005/117485 | 12/2005 |
| WO | 2006/123495 | 11/2006 |

* cited by examiner

HOWLING SUPPRESSION DEVICE, HOWLING SUPPRESSION METHOD, PROGRAM, AND INTEGRATED CIRCUIT

TECHNICAL FIELD

The present invention relates to a howling suppression device which suppresses, in an electroacoustic apparatus including a microphone and a speaker, howling which is caused by acoustic coupling between the speaker and the microphone.

BACKGROUND ART

Generally, in the electroacoustic apparatus including the microphone and the speaker, there is a case where howling is caused by an acoustic feedback loop which is formed when a sound output is from speaker returns to the microphone.

A conventional howling suppression device suggested for suppressing howling is a device which suppresses howling by extracting a howling component included in an input signal and subtracting the extracted howling component from the input signal (for example, see Patent Literature 1).

FIG. 12 is a block diagram showing a conventional howling suppression device 1000 described in Patent Literature 1. As shown in FIG. 12, the conventional howling suppression device 1000 includes: an input terminal 1001 into which a signal is input; a delay unit 1002 which delays the input signal; an adaptive filter 1003 which extracts a howling component from the input signal; a subtractor 1004 which subtracts, from the input signal, a signal output from the adaptive filter 1003; and an output terminal 1005 which outputs a signal with which howling is suppressed.

Next, an operation of the conventional howling suppression device 1000 described in Patent Literature 1 will be described.

A signal is input into the input terminal 1001 from the microphone which is not shown in the figure. The delay unit 1002 delays the signal input into the input terminal 1001, and outputs the delayed signal to the adaptive filter 1003 as a reference signal. The adaptive filter 1003 convolves the input signal (reference signal) delayed by the delay unit 1002 with a filter coefficient, so as to generate a signal having a delay of an integral multiple of a period of the howling component included in the input signal. The subtractor 1004 suppresses the howling by subtracting, from the input signal, the signal output from the adaptive filter 1003, and outputs the signal after howling suppression to the adaptive filter 1003 and the output terminal 1005. The adaptive filter 1003 sequentially updates the filter coefficient so that the mean square of the signal output from the subtractor 1004 is smallest.

As described above, the conventional howling suppression device 1000 described in Patent Literature 1 can suppress howling by extracting, using an adaptive filter, a howling component included in an input signal and subtracting the extracted howling component from the input signal.

CITATION LIST

Patent Literature

Japanese Unexamined Patent Application Publication No. 2001-275182

SUMMARY OF INVENTION

Technical Problem

In the conventional howling suppression device 1000 as described above, it is necessary to continuously input a howling component into the adaptive filter 1003 so as to allow the adaptive filter 1003 to perform filter coefficient learning for suppressing howling. However, at the time of occurrence of howling, an acoustic feedback loop is formed, so that such suppression of howling also suppresses the signal that is necessary for the adaptive filter 1003 to perform the filter coefficient learning. If the filter coefficient learning continues in this state, a conventional problem of inappropriate adaption arises, which causes deterioration in the quality of the processed sound.

The present invention has been conceived to solve the problem above, and it is an object of the present invention to provide a howling suppression device which can effectively suppress howling even in an acoustic feedback loop environment and can also reduce quality deterioration of processed sound involved in the howling suppression.

Solution to Problem

A howling suppression device according to an aspect of the present invention suppresses a howling component included in an input signal. Specifically, the howling suppression device includes: a delay unit which delays the input signal so as to output the delayed input signal as a reference signal; a signal separation unit including an adaptive filter which extracts a periodic signal component from the reference signal by adaptively updating a filter coefficient; a howling detection unit which detects an occurrence of howling using at least a signal of the periodic signal component output from the adaptive filter; and a howling suppression unit including: a first suppression filter which obtains the updated filter coefficient from the adaptive filter with timing when the howling detection unit detects the occurrence of the howling, and extracts the periodic signal component from the reference signal based on the filter coefficient; and a first subtractor which subtracts the periodic signal component from the input signal so as to output a signal obtained by the subtraction. As the configuration shows, the howling suppression device according to the aspect of the present invention can effectively suppress howling even in an acoustic feedback loop environment and can also reduce quality deterioration of processed sound involved in the howling suppression, by using, as a semi-fixed filter, the filter coefficient of the adaptive filter, which is used in the howling detection.

In addition, the signal separation unit further includes a second subtractor which subtracts the periodic signal component from the input signal so as to output an aperiodic signal component obtained by the subtraction. The adaptive filter updates the filter coefficient, based on the reference signal output from the delay unit and the aperiodic signal component output from the second subtractor. The first suppression filter may obtain the updated filter coefficient from the adaptive filter when the howling detection unit detects the occurrence of the howling. As the configuration shows, the howling suppression device according to another aspect of the present invention can use, for a semi-fixed filter for howling suppression, the filter coefficient of the adaptive filter, which is used in detecting the howling.

In addition, the howling detection unit may include: a first level calculation unit which calculates a signal level of the periodic signal component output from the adaptive filter; a second level calculation unit which calculates a signal level of the aperiodic signal component output from the second subtractor; a level ratio calculation unit which calculates a relative level ratio between the signal level output from the first level calculation unit and the signal level output from the second level calculation unit; and a howling determination unit which determines that the howling has occurred when the relative level ratio calculated by the level ratio calculation unit continues to be above a predetermined threshold for a predetermined period of time. As the configuration shows, the howling suppression device according to an aspect of the present invention can detect the howling with accuracy by analyzing the relative level ratio between the periodic signal component and the aperiodic signal component.

In addition, the howling detection unit may include: a level calculation unit which calculates a signal level of the periodic signal component output from the adaptive filter; a level change analysis unit which analyzes time change of the signal level output from the level calculation unit; and a howling determination unit which determines that the howling has occurred when the signal level of the periodic signal component continues to increase with time for a predetermined period of time. As the configuration shows, the howling suppression device according to an aspect of the present invention can detect the howling with accuracy by analyzing the time change of the signal level of the periodic signal component.

In addition, the howling detection unit may include: a band division unit which divides, into band signals, the signal of the periodic signal component output from the adaptive filter; a band level calculation unit which calculates signal levels of the band signals output from the band division unit; and a howling determination unit which determines that the howling has occurred, when all the signal levels of at least one of the band signals are above a predetermined threshold, the signal levels being calculated during a predetermined period of time. As the configuration shows, the howling suppression device according to an aspect of the present invention can detect the howling with accuracy by analyzing frequency characteristics of the signal of the periodic signal component.

In addition, the howling suppression unit further includes a second suppression filter which, when the howling detection unit detects the occurrence of the howling, obtains the filter coefficient currently held by the first suppression filter before the first suppression filter obtains another filter coefficient from the adaptive filter, and which extracts the periodic signal component from the reference signal based on the filter coefficient. The first subtractor may subtract, from the input signal, the periodic signal components output from the first and second suppression filters, so as to output an error signal.

As the configuration shows, the howling suppression device according to an aspect of the present invention can suppress, at the same time, plural howls occurring with different timings, by using plural semi-fixed filters.

In addition, the howling suppression unit may include a gain control unit which controls a gain of the signal of the periodic signal component output from the first suppression filter. As the configuration shows, the howling suppression device according to an aspect of the present invention can control an amount of howling to be suppressed, by controlling the gain of the signal output from the semi-fixed filter.

In addition, the gain control unit may change the gain of the signal output from the first suppression filter according to an amplitude of the howling component included in the input signal. As the configuration shows, the howling suppression device according to an aspect of the present invention can reduce gain loss in frequency characteristics of the processed sound involved in the howling suppression processing, by adaptively controlling the gain of the signal output from the semi-fixed filter according to the amplitude of the howling component included in the input signal.

In addition, the gain control unit may include a fixed gain for adjusting an amount of howling to be suppressed. As the configuration shows, the howling suppression device according to an aspect of the present invention can control an amount of howling to be suppressed, by controlling the gain of the signal output from the semi-fixed filter using the fixed gain.

In addition, the howling suppression device may further include a band-limiting filter which outputs, to the delay unit, only a signal of a band at which howling is expected to occur, among bands of the input signal. As the configuration shows, the howling suppression device according to an aspect of the present invention can improve accuracy in extracting the howling component in the adaptive filter by performing, in the processing, band limitation on the band at which the howling is expected to occur.

In addition, when the howling detection unit detects the occurrence of the howling, the adaptive filter may reset the filter coefficient currently held and recalculate the filter coefficient based on the reference signal output from the delay unit and the aperiodic signal component output from the second subtractor. With this configuration, it is possible to obtain the filter coefficient that allows extracting only the howling component with accuracy.

A howling suppression method according to an aspect of the present invention is suppressing a howling component included in the input signal. Specifically, the howling suppression method includes: delaying the input signal so as to output the delayed signal as a reference signal; processing including extracting a periodic signal component from the reference signal by adaptively updating a filter coefficient; detecting an occurrence of howling using at least a signal of the periodic signal component output in the extracting; and processing including: obtaining, by a first suppression filter, the filter coefficient updated in the extracting, with timing when the occurrence of the howling is detected in the detecting, and extracting, by the first suppression filter, the periodic signal component from the reference signal based on the filter coefficient; and subtracting the periodic signal component from the input signal so as to output a signal obtained by the subtraction.

A program according to an aspect of the present invention causes a computer to suppress a howling component included in the input signal. Specifically, the program causes the computer to execute: delaying the input signal so as to output the delayed signal as a reference signal; processing including extracting a periodic signal component from the reference signal by adaptively updating a filter coefficient; detecting an occurrence of howling using at least a signal of the periodic signal component output in the extracting; and processing including: obtaining, by a first suppression filter, the filter coefficient updated in the extracting, with timing when the occurrence of the howling is detected in the detecting, and extracting, by the first suppression filter, the periodic signal component from the reference signal based on the filter coefficient; and subtracting the periodic signal component from the input signal so as to output a signal obtained by the subtraction.

An integrated circuit according to an aspect of the present invention suppresses a howling component included in the input signal. Specifically, the integrated circuit includes: a delay unit which delays the input signal so as to output the delayed input signal as a reference signal; a signal separation unit including an adaptive filter which extracts a periodic signal component from the reference signal by adaptively updating a filter coefficient; a howling detection unit which detects an occurrence of howling using at least a signal of the periodic signal component output from the adaptive filter; and a howling suppression unit including: a first suppression filter which obtains the updated filter coefficient from the adaptive filter with timing when the howling detection unit detects the occurrence of the howling, and extracts the periodic signal component from the reference signal based on the filter coefficient; and a first subtractor which subtracts the periodic signal component from the input signal so as to output a signal obtained by the subtraction.

Advantageous Effects of Invention

As described above, according to an implementation of the present invention, it is possible to provide a howling suppression device which can effectively suppress howling under an acoustic feedback loop environment and can also reduce quality deterioration of processed sound involved in the howling suppression.

DESCRIPTION OF EMBODIMENTS

Hereinafter, embodiments of the present invention will be described with reference to the drawings.

Embodiment 1

Figure 1:
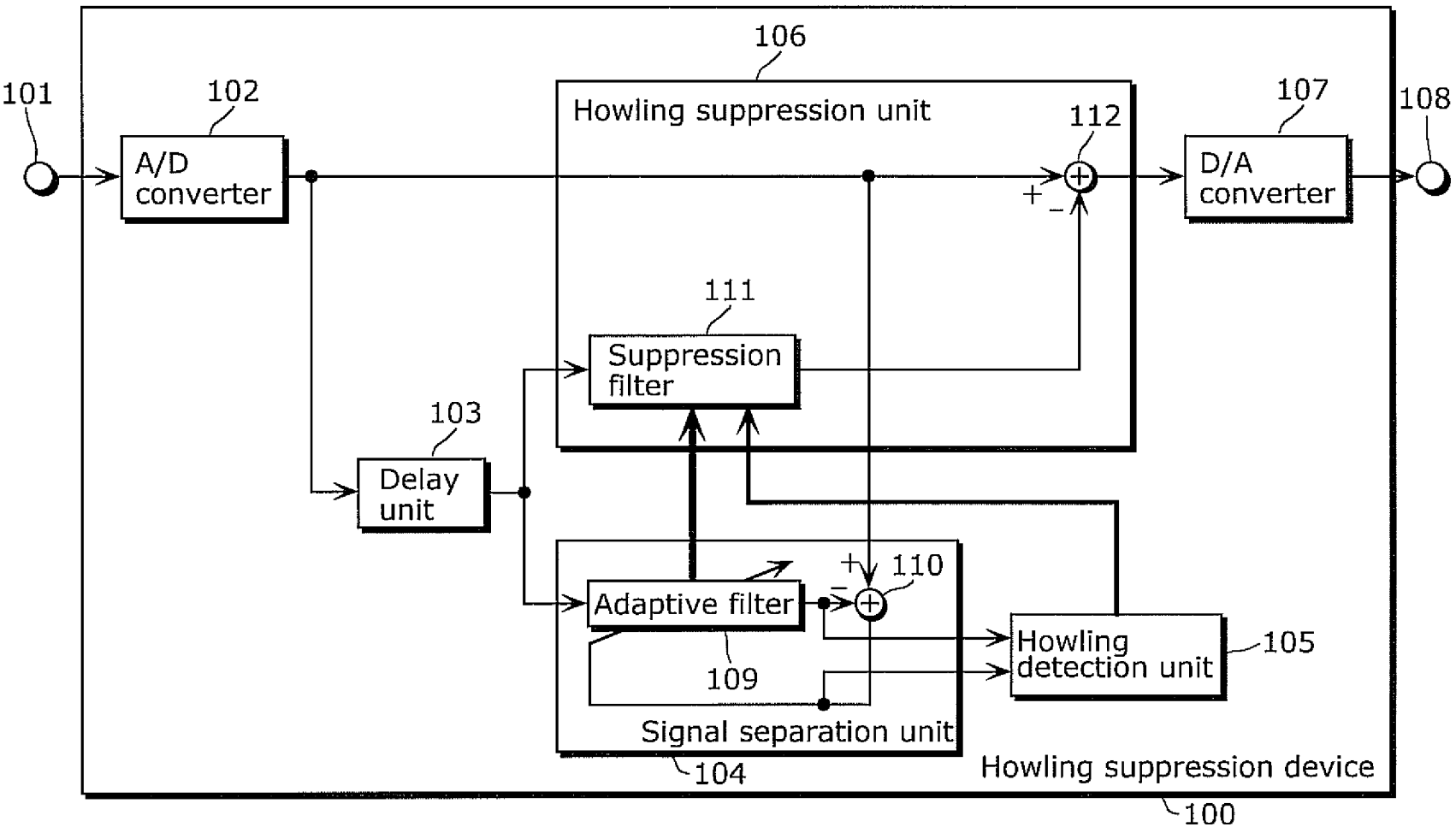
FIG. 1 is a block diagram of a howling suppression device according to a first embodiment of the present invention.

FIG. 1 is a block diagram of a howling suppression device 100 according to a first embodiment of the present invention.

A howling suppression device 100 includes: an input terminal 101 into which a signal is input from a microphone not shown in the figure; an A/D converter 102 which performs analog-to-digital conversion on the signal input into the input terminal 101; a delay unit 103 which generates a reference signal of an adaptive filter 109 to be described later by delaying the signal output from the A/D converter 102; a signal separation unit 104 which separates the signal output from the A/D converter 102 into a periodic signal component and an aperiodic signal component; a howling detection unit 105 which detects an occurrence of howling using the signal output from the signal separation unit 104; a howling suppression unit 106 which suppresses the howling based on a result of the howling detection performed by the howling detection unit 105; a D/A converter 107 which performs digital-to-analog conversion on the signal output from the howling suppression unit 106; and an output terminal 108 which outputs the signal output from the D/A converter, to an amplifier or the like that is not shown in the figure.

In addition, the signal separation unit 104 includes: an adaptive filter 109 which convolves the signal (reference signal) output from the delay unit 103 with the filter coefficient while adaptively updating the filter coefficient, and a subtractor (second subtractor) 110 which calculates a difference (referred to as an "aperiodic signal component" or "error signal") between the signal output from the A/D converter 102 and the signal output from the adaptive filter 109.

Figure 2:
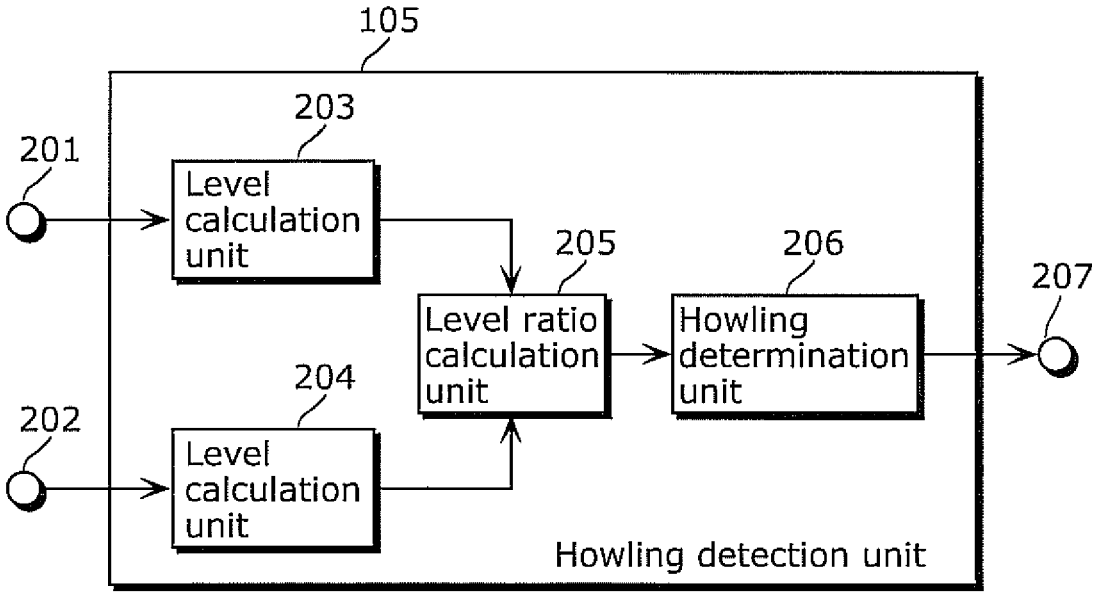
FIG. 2 is a block diagram of a howling detection unit included in the howling suppression device according to the first embodiment of the present invention.

In addition, as shown in FIG. 2, the howling detection unit 105 includes: an input terminal 201 into which a periodic signal component separated by the signal separation unit 104 is input; an input terminal 202 into which an aperiodic signal component separated by the signal separation unit 104 is input; a level calculation unit 203 which calculates a signal level of the periodic signal component input into the input terminal 201; a level calculation unit 204 which calculates a signal level of the aperiodic signal component input into the input terminal 202; a level ratio calculation unit 205 which calculates a relative level ratio between the signal level output from the level calculation unit 203 and the signal level output from the level calculation unit 204; a howling determination unit 206 which determines whether or not howling has occurred, using the level ratio calculated by the level ratio calculation unit 205; and an output terminal 207 which outputs a result of the determination performed by the howling determination unit 206.

In addition, the howling suppression unit 106 includes: a suppression filter 111 which convolves the signal (reference signal) output from the delay unit 103 with the filter coefficient, and a subtractor (a first subtractor) 112 which calculates a difference (output signal) between the signal output from the A/D converter 102 (input signal) and the signal output from the suppression filter 111.

Next, an operation of the howling suppression device 100 according to the first embodiment will be described.

First, an operation of the entire howling suppression device 100 according to the first embodiment will be described.

A signal which is input into the input terminal 101 from the microphone not shown in the figure is converted from analog to digital by the A/D converter 102, and is then input into each of the delay unit 103 and the howling suppression unit 106. The signal delayed by the delay unit 103 is input into each of the signal separation unit 104 and the howling suppression unit 106.

The signal separation unit 104 separates the signal output from the A/D converter 102, into a periodic signal component and an aperiodic signal component, and outputs, of the signals resulted from the signal separation, the periodic signal component and the aperiodic signal component to the input terminal 201 and the input terminal 202 in the howling detection unit 105, respectively. The howling detection unit 105 performs howling detection using the signal components input respectively into the input terminals 201 and 202.

The howling suppression unit 106 suppresses the howling using the signal components input from the A/D converter 102 and the delay unit 103 respectively, and the signal with which howling is suppressed is converted from digital to analog by the D/A converter 107, and is then output to the output terminal 108 connected to an amplifier or the like that is not shown in the figure.

Next, an operation of the signal separation unit 104 will be described.

When assuming that the signal output from the A/D converter 102 is a target signal, the signal obtained by delaying the target signal by the delay unit 103 is input into the adaptive filter 109 as a reference signal. Here, an amount of the delay by the delay unit 103 is set to a value such that the signal components included in the target signal and the reference signal do not correlate with each other (for example, approximately as samples 1 to 8). The adaptive filter 109 convolves the reference signal with the filter coefficient, and outputs the periodic signal component. To "convolve" is to add results obtained by multiplying respective samples included in the reference signal by filter coefficients. The same is applicable to the suppression filters 111 and 501 to be described later. The subtractor 110 calculates an error signal (aperiodic signal component) by subtracting, from the target signal, the signal (periodic signal component) output from the adaptive filter 109.

The adaptive filter 104 is, for example, a 32-tap finite impulse response (FIR) filter. The filter coefficient of the adaptive filter 109 is updated so that the mean square of the error signal is smallest. The mean square error is smallest when the adaptive filter 109 outputs a signal having a correlation between the target signal and the reference signal, that is, a periodic signal component such as howling. As a result, it is possible to extract the periodic signal component such as howling from the input signal. As an algorithm for updating the coefficient of the adaptive filter 109, various types of known adaptive algorithms such as the normalized least mean square (NLMS) algorithm are used. As a result, the signal separation unit 104 outputs the signal from the adaptive filter 109 as the periodic signal component of the input signal, and the error signal as the aperiodic signal component of the input signal.

Next, an operation of the howling detection unit 105 will be described. The howling detection unit 105 detects howling, considering the following two characteristics of howling: (1) howling is a sine-wave signal, that is, a periodic signal; and (2) howling temporally continues at a prominent level.

The level calculation unit 203 calculates a signal level of the periodic signal component input into the input terminal 201. The level calculation unit 204 calculates a signal level of the aperiodic signal component input into the input terminal 202.

The level ratio calculation unit 205 calculates a level ratio indicating a relative ratio between signal levels of the signals that are output from the level calculation units 203 and 204, respectively. When howling occurs, the signal level of the aperiodic signal component decreases whereas the signal level of the periodic signal component increases. Here, for example, assuming that the signal level of the periodic signal component is a numerator and the signal level of the aperiodic signal component is a denominator, when calculating the relative level ratio between these signal levels, the level ratio increases at the time of occurrence of howling. Thus, it is possible to detect howling by observing a behavior of this level ratio.

The howling determination unit 206 compares the level ratio output from the level ratio calculation unit 205 with a first threshold that is previously determined, and a counter value is incremented when the level ratio is above the first threshold. When the counter value is above a second threshold that is previously determined, it is determined that howling has occurred based on an assumption that a state in which a significant level ratio (for example, approximately 0.5 second to 1 second) temporally continues. The result of the determination is output from the output terminal 207.

Figure 3:
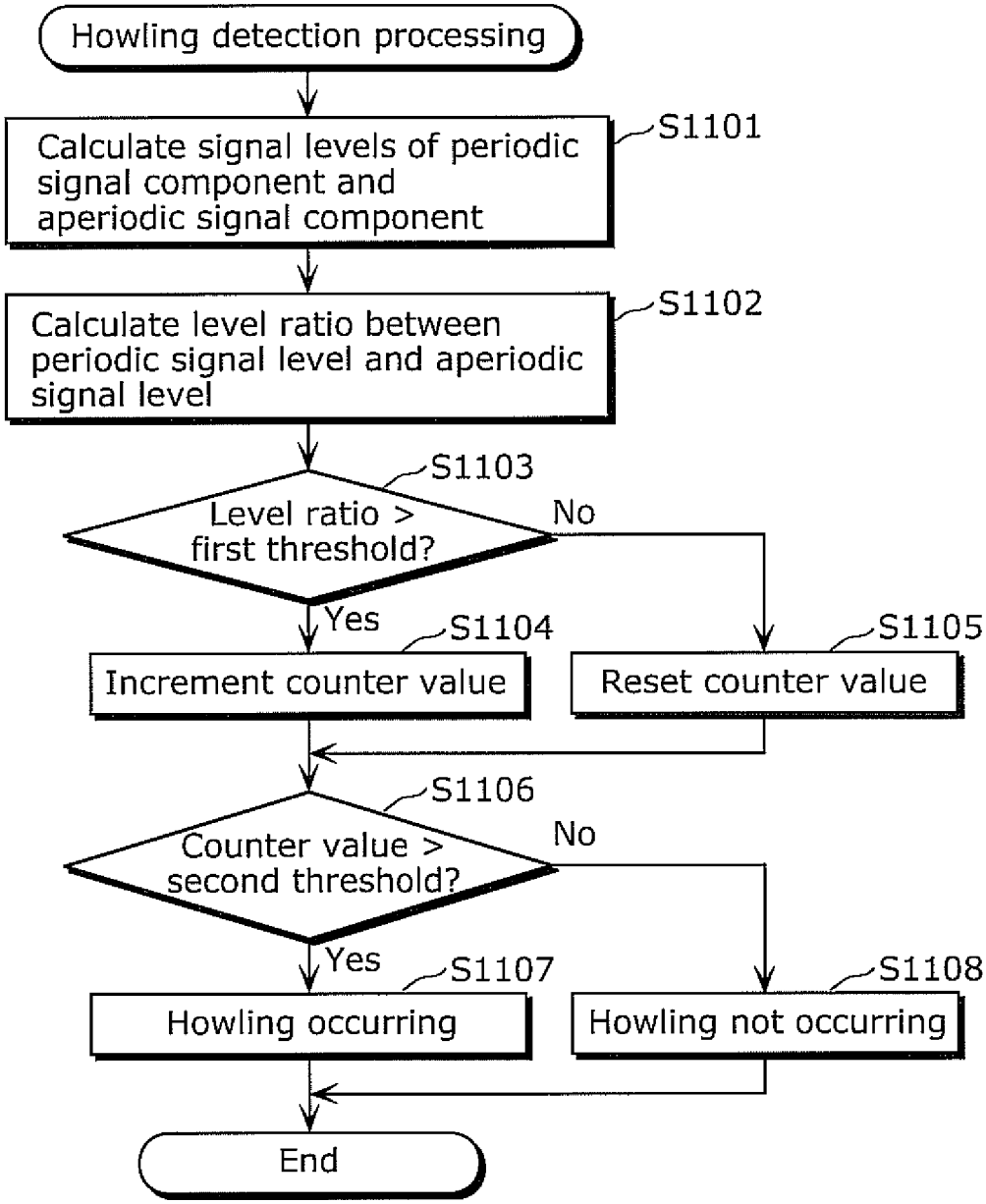
FIG. 3 is a processing flowchart of the howling detection unit according to the first embodiment of the present invention.

FIG. 3 is a processing flowchart showing an operation of the howling detection unit 105. First, the level calculation units 203 and 204 calculate each of the signal levels of the periodic signal component and the aperiodic signal component (S1101). Next, the level ratio calculation unit 205 calculates the level ratio indicating the relative level ratio between the signal levels, that is, the signal level of the periodic signal component calculated by the level calculation unit 203 and the signal level of the aperiodic signal component calculated by the level calculation unit 204 (S1102).

Next, the howling determination unit 206 compares the level ratio calculated by the level ratio calculation unit 205 with the first threshold (S1103). Then, when the level ratio is above the first threshold (Yes in S1103), the howling determination unit 206 increments the counter value (S1104). On the other hand, when the level ratio is not above the first threshold (No in S1103), the howling determination unit 206 clears the counter value (S1105).

Next, the howling determination unit 206 compares the counter value with the second threshold (S1106). Then, the howling determination unit 206 determines that the howling has occurred (S1107) when the counter value is above the second threshold (Yes in S1106), and determines that the howling has not occurred (S1108) when the counter value is not above the second threshold (No in S1106), so as to output the result of the determination. Note that the second threshold here is, for example, a value equivalent to 0.5 second to 1 second. The same is applied to the second threshold in the second and third embodiments.

Next, an operation of the howling suppression unit 106 will be described. The howling suppression unit 106 obtains the result of the howling detection performed by the howling detection unit 105, and starts the howling suppression processing when the howling is detected. Here, the filter coefficient of the suppression filter 111 is set to zero at initial state.

When the howling detection unit 105 detects howling, the filter coefficient of the adaptive filter 109 is set to the filter coefficient for extracting the howling component included in the input signal. Here, the suppression filter 111 obtains the filter coefficient of the adaptive filter 109 that is used in detecting howling, and sets the filter coefficient for a semi-fixed filter.

Specifically, the suppression filter 111 obtains the filter coefficient from the adaptive filter 109, convolves the signal input from the delay unit 103 with the filter coefficient, and outputs the periodic signal component. The subtractor 112 suppresses the howling by subtracting the signal output from the suppression filter 111, from the signal input from the A/D converter 102. The signal with which howling is suppressed is output to the D/A converter 107.

Although suppression of the howling suppresses the signal (=the howling component) necessary for the adaptive filter 109 to learn the filter coefficient, it is possible to reduce the quality deterioration of the processed sound which is caused by inappropriate learning by the adaptive filter 109, by using the configuration that is additionally equipped with a semi-fixed filter coefficient for howling suppression as the suppression filter 111, instead of directly suppressing the howling using the adaptive filter 109.

Figure 4:
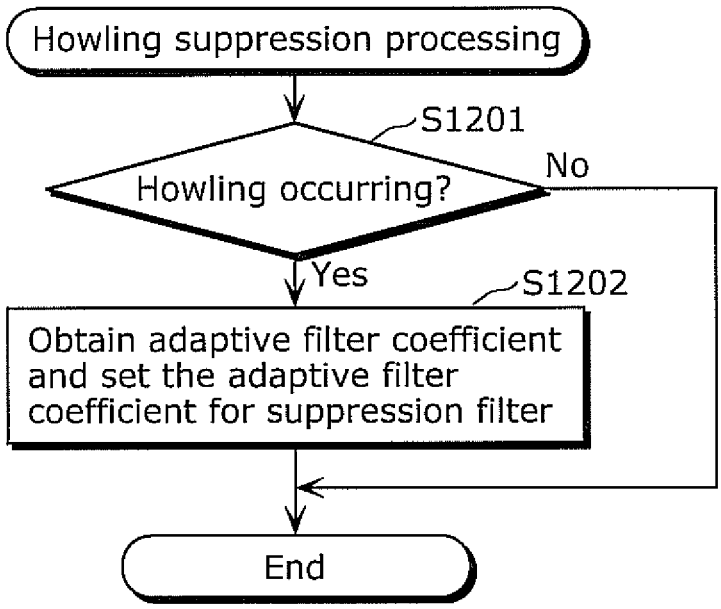
FIG. 4 is a processing flowchart of a howling suppression unit according to the first embodiment of the present invention.

FIG. 4 is a processing flowchart showing an operation of the howling suppression unit 106.

First, the suppression filter 111 obtains the result of the howling detection performed by the howling detection unit 105, so as to determine whether or not howling is detected (S1201). When howling is detected (Yes in S1201), the suppression filter 111 obtains the filter coefficient of the adaptive filter 109 at the point in time, and starts the howling suppression processing by setting the obtained filter coefficient for the semi-fixed filter (S1202).

Note that in the above example of the howling suppression device 100 according to the first embodiment, the suppression filter 111 determines whether or not howling has occurred based on the result of the howling detection, and obtains the filter coefficient from the adaptive filter 109 when the howling is detected. However, the configuration according to the present invention is not limited to this, and for example, the adaptive filter 109 may determine whether or not howling has occurred based on the result of the howling detection and transfer the filter coefficient to the suppression filter 111 when the howling is detected.

As described above, the howling suppression device 100 according to the first embodiment detects howling by analyzing the relative level ratio between the signals of the periodic signal component and of the aperiodic signal component, which are included in the input signal. Then, the filter coefficient of the adaptive filter, which is used in the howling detection, is used for howling suppression as a semi-fixed filter. Thus, even in the acoustic feedback loop environment, it is possible to effectively suppress howling and reduce quality degradation of the processed sound involved in the howling suppression.

In addition, with the configuration in which the signal separation processing and the howling suppression processing are concurrently performed in parallel, it is possible to adaptively suppress howling accordingly even in the case where howling frequency changes along with change in acoustic environment. In addition, with the configuration sharing the filter coefficient between the signal separation processing and the howling suppression processing, it is not necessary to separately design or previously prepare a filter coefficient for howling suppression according to the result of the howling detection, thus allowing reduction in hardware resources.

Note that the first embodiment has been described assuming that: when the howling detection unit 105 detects howling in the first embodiment, the suppression filter 111 obtains and sets, for the semi-fixed filter, the filter coefficient of the adaptive filter 109 which is used in the howling detection. In this case, the adaptive filter 109 may reset the filter coefficient for relearning in order to improve extraction accuracy of the howling component included in the input signal. Then, the suppression filter 111 may obtain the filter coefficient that is relearned and set the relearned filter coefficient for the semi-fixed filter.

The adaptive filter 109 can perform: "filter coefficient update processing" to calculate another filter coefficient based on the reference signal output from the delay unit 103 and the aperiodic signal component output from the subtractor 110, and "filter coefficient relearning" that is to reset the filter coefficient currently held and calculate another filter coefficient based on the reference signal output from the delay unit 103 and the aperiodic signal component output from the subtractor 110 when the howling detection unit 105 detects howling.

In the "filter coefficient update processing", it is not possible to eliminate the influence of the periodic signal component that is not the howling component. This makes it difficult to appropriately extract only the howling component using the filter coefficient that is obtained through repeated execution of the processing. Thus, with timing when the howling detection unit 105 detects howling, it is possible to obtain the filter coefficient that allows extracting only the howling component with high accuracy, by canceling the current filter coefficient and calculating another filter coefficient from the start (filter coefficient relearning).

In addition, the howling detection unit 105 in the first embodiment has been described with an example where the occurrence of howling is detected based on the periodic signal component input into the input terminal 201 and the aperiodic signal component input into the input terminal 202; however, the present invention is not limited to this, and the occurrence of howling may also be detected based only on the periodic component as shown in the second and third embodiments.

Embodiment 2

Figure 5:
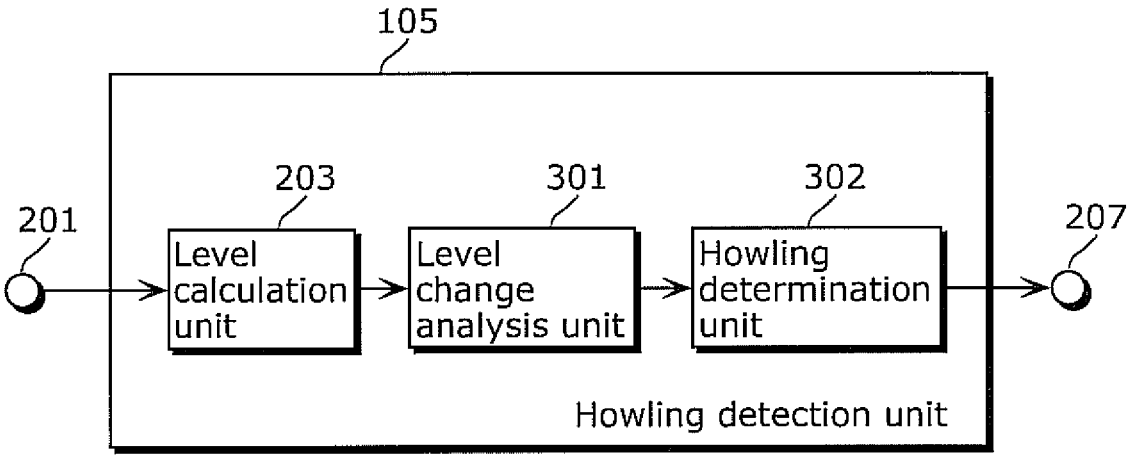
FIG. 5 is a block diagram of a howling detection unit according to a second embodiment of the present invention.

FIG. 5 is a block diagram showing a configuration of the howling detection unit 105 in the howling suppression device 100 according to a second embodiment of the present invention. Note that in FIG. 5, the same reference signs are used for the same constituent elements in FIG. 2, and the descriptions thereof are omitted.

In FIG. 5, the howling detection unit 105 according to the second embodiment includes a level change analysis unit 301 which analyses time change of the signal level calculated by the level calculation unit 203 and a howling determination unit 302 which determines whether or not howling has occurred based on the result of the analysis performed by the level change analysis unit 301.

Next, an operation of the howling suppression device 100 according to the second embodiment will be described.

The level change analysis unit 301 calculates a difference value between a previous value and a current value of the signal level of the periodic signal component output from the level calculation unit 203, so as to output the difference value to the howling determination unit 302. Here, the previous signal value is generated by the delay unit not shown in the figure.

The howling determination unit 302 compares the difference value output from the level change analysis unit 301 with a first threshold, and increments the counter value when the difference value is above the first threshold. When the counter value is above a second threshold that is previously determined, the howling determination unit 302 determines that howling has occurred, based on an assumption that the signal level of the periodic signal component output from the level calculation unit 203 increases with time (that is, from past to present).

Note that the state where "the signal level increases with time from past to present" does not mean that all the difference values (from past to present) calculated by the level change analysis unit 301 should be positive, but means that it is sufficient that the signal level increases from past to present as a general tendency.

As described above, the howling suppression device 100 according to the second embodiment can detect howling with accuracy by analyzing the temporal change of the signal level of the periodic signal component included in the input signal, thus allowing setting of the semi-fixed filter which can effectively suppress the howling.

Note that in the second embodiment, the level change analysis unit 301 has been described as calculating the difference value between the previous and current values of the periodic component, but the previous and current values of the periodic component may be compared, and the result may be used for howling determination performed by the howling determination unit 302.

Embodiment 3

Figure 6:
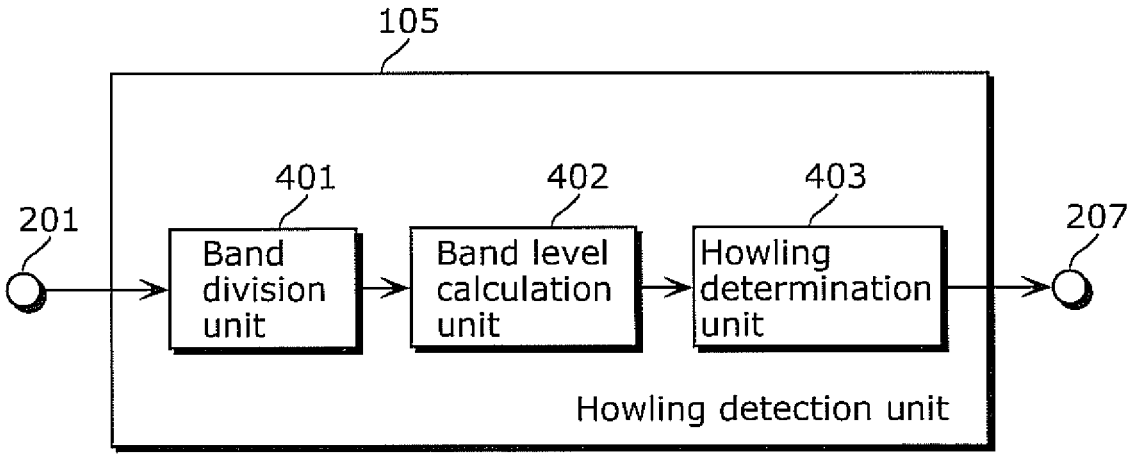
FIG. 6 is a block diagram of a howling detection unit according to a third embodiment of the present invention.

FIG. 6 is a block diagram showing a configuration of the howling detection unit 105 in the howling suppression device 100 according to a third embodiment of the present invention. Note that in FIG. 6, the same reference signs are used for the same constituent elements in FIG. 2, and the descriptions thereof are omitted.

In FIG. 6, the howling detection unit 105 according to the third embodiment includes: a band division unit 401 which divides, into band signals, the signal of the periodic signal component input into the input terminal 201; a band level calculation unit 402 which calculates signal levels of the band signals output from the band division unit 401; and a howling determination unit 403 which determines whether or not howling has occurred using the signal levels of the band signals calculated by the band level calculation unit 402.

Next, an operation of the howling suppression device 100 according to the third embodiment will be described. Here, the howling determination unit 403 performs the howling determination processing for each of the bands, separately and in parallel.

The band division unit 401 performs frequency conversion on the signal of the periodic signal component input into the input terminal 201, and divides the periodic signal component into band signals. For example, an audible range (20 Hz to 20 kHz) is divided into 100 to 300 (more specifically, into 128 and 256). In addition, as a method for band division, known methods of dividing a time signal into band signals are used, such as a fast Fourier transform, and a filter bank made up of plural finite impulse response (FIR) filters or infinite impulse response (IIR) filters. The band level calculation unit 402 calculates the signal level of each of the band signals output from the band division unit 401.

The howling determination unit 403 compares the signal level of each of the band signals output from the band level calculation unit 402 with the first threshold that is previously determined, and increments the counter value when the signal level is above the first threshold. On the other hand, the howling determination unit 403 resets the counter value when the signal value is equal to or below the first threshold. Then, when the counter value is above the second threshold that is previously determined, the howling determination unit 403 determines that howling has occurred.

Specifically, the howling determination unit 403 determines that howling has occurred when, for at least one of the band signals, the counter value of the signals above the first threshold continues to be equal to or above the second threshold, in other words, when all the signal levels within a predetermined period of time (second threshold) is above the first threshold.

As described above, the howling suppression device 100 according to the third embodiment can detect howling with accuracy by analyzing frequency characteristics of the signal level of the periodic signal component included in the input signal, thus allowing setting of the semi-fixed filter that can effectively suppress the howling.

Embodiment 4

Figure 7:
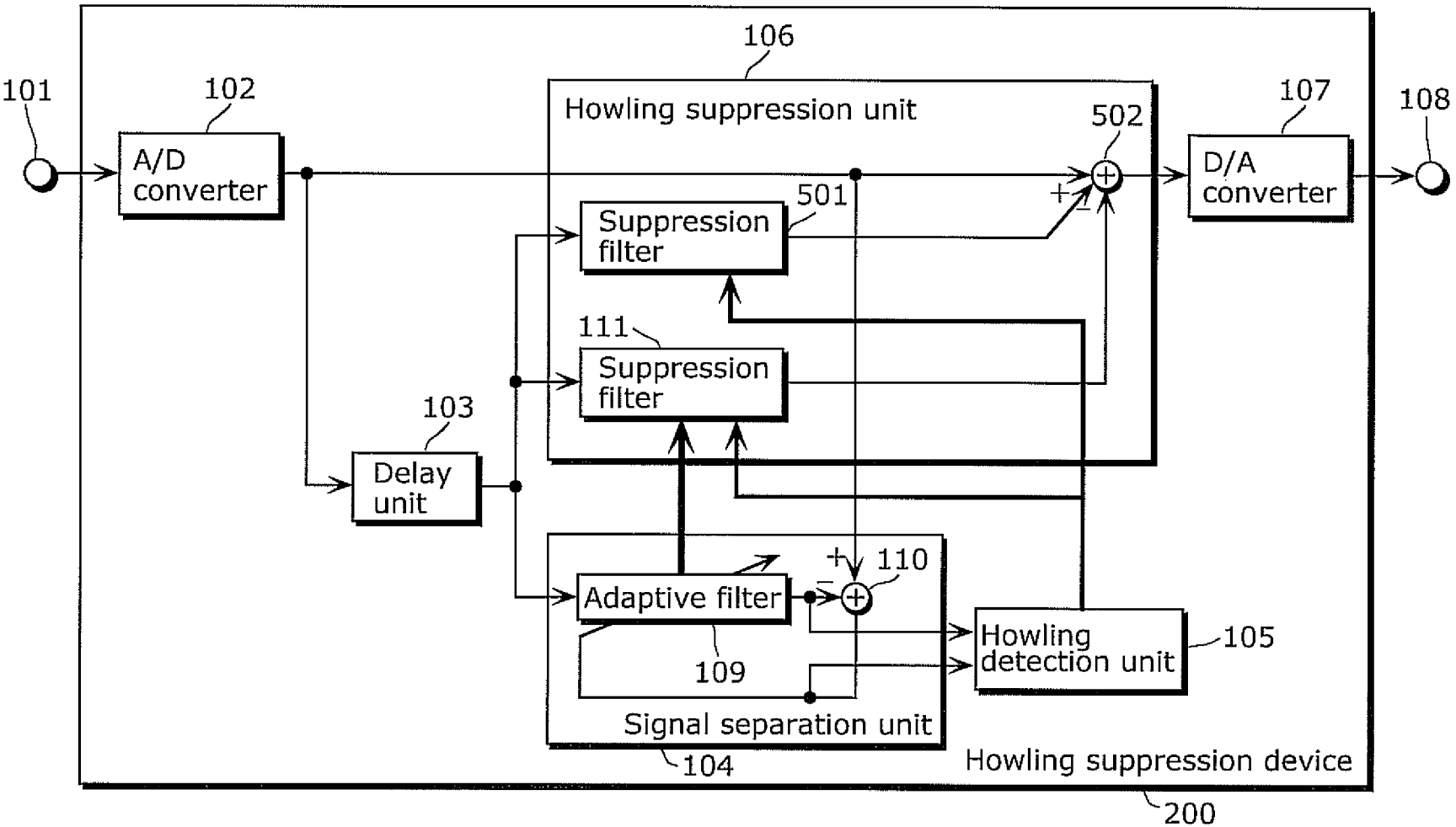
FIG. 7 is a block diagram of a howling suppression device according to a fourth embodiment of the present invention.

FIG. 7 is a block diagram of a howling suppression device 200 according to a fourth embodiment of the present invention. Note that in FIG. 7, the same reference signs are used for the same constituent elements in FIG. 1, and the descriptions thereof are omitted.

In FIG. 7, the howling suppression device 200 according to the fourth embodiment includes: a suppression filter 501 which convolves the signal output from the delay unit 103 with the filter coefficient; and a subtractor 502 which calculates a difference obtained by subtracting, from the signal output from the A/D converter 102, the signal output from the suppression filter 111 (first suppression filter) and the signal output from the suppression filter 501 (second suppression filter).

Next, an operation of the howling suppression device 200 according to the fourth embodiment will be described.

When the howling detection unit 105 detects howling, first, the suppression filter 501 obtains the filter coefficient of the suppression filter 111 and sets the obtained filter coefficient for the semi-fixed filter. Next, the suppression filter 111 obtains the filter coefficient of the adaptive filter 109 and sets the filter coefficient for the semi-fixed filter. In other words, the suppression filter 501 obtains a filter coefficient that is held before the suppression filter 111 obtains the filter coefficient from the adaptive filter 109. On the other hand, the suppression filter 111 obtains the filter coefficient from the adaptive filter 109 after notifying the suppression filter 501 of the filter coefficient.

Each of the suppression filter 111 and the suppression filter 501 convolves the signal input from the delay unit 103 with the filter coefficient. Then, the subtractor 502 suppresses the howling by subtracting the signal output from the suppression filter 111 and the signal output from the suppression filter 501, from the signal input from the A/D converter 102.

As described above, the howling suppression device 200 according to the fourth embodiment can suppress, at the same time, two howls occurring with different timings, by providing the two suppression filters 111 and 501 for howling suppression.

Note that the two suppression filters have been described as being used for howling suppression in the fourth embodiment, but the present invention is not limited to this, and any appropriate number of suppression filters may be included as required according to the acoustic environment in which the suppression filters are used or an assumed environment in which the howling is expected to occur. In addition, the semi-fixed filters used for howling suppression have been described as having a parallel configuration, but may have a cascade configuration.

Embodiment 5

Figure 8:
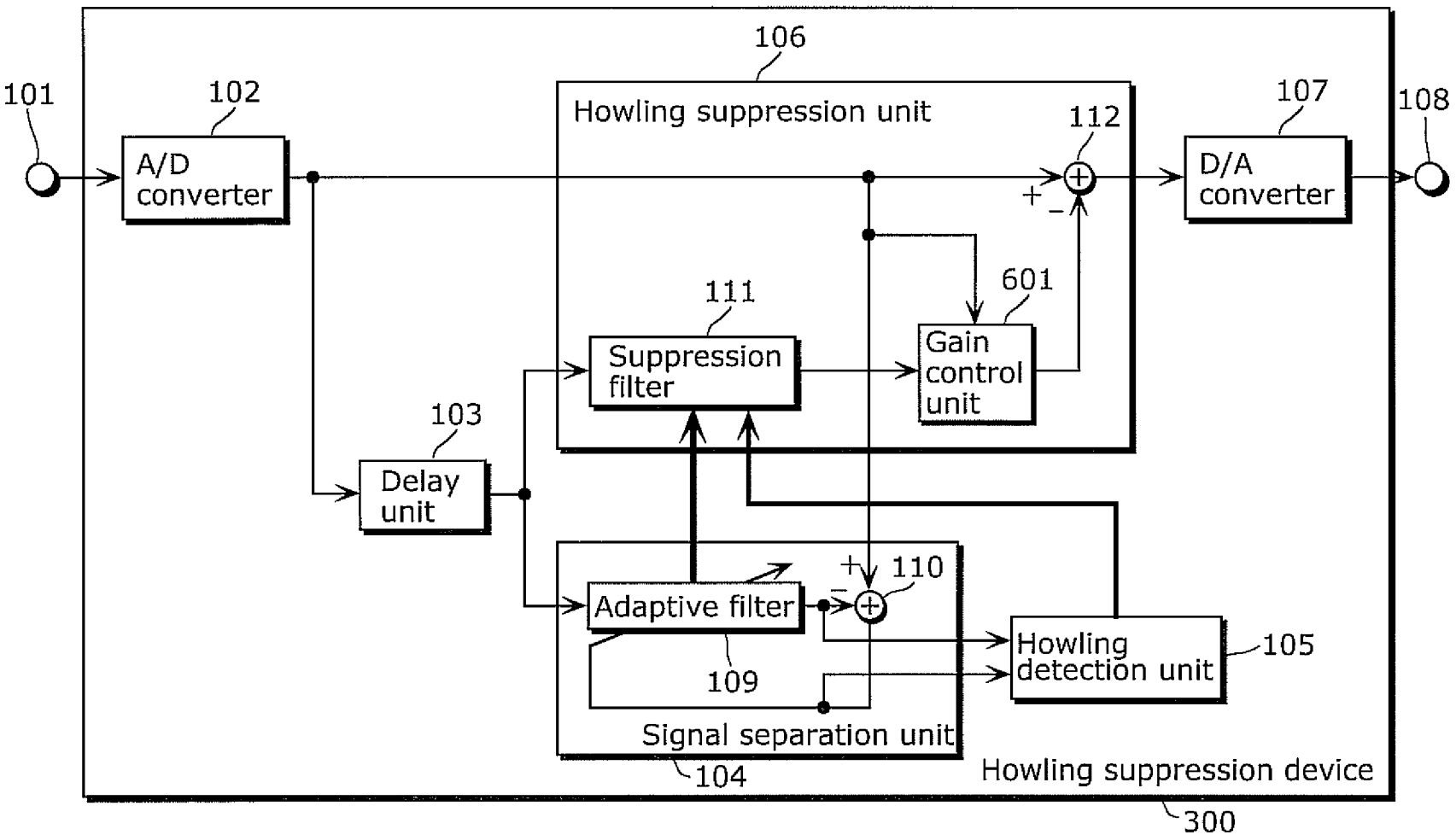
FIG. 8 is a block diagram of a howling suppression device according to a fifth embodiment of the present invention.

FIG. 8 is a block diagram of a howling suppression device 300 according to a fifth embodiment of the present invention. Note that in FIG. 8, the same reference signs are used for the same constituent elements in FIG. 1, and the descriptions thereof are omitted.

In FIG. 8, the howling suppression device 300 according to the fifth embodiment includes a gain control unit 601 which controls a gain of a signal output from the suppression filter 111.

In addition, the gain control unit 601 includes: an input terminal 701 into which the signal output from the A/D converter 102 is input; an input terminal 702 into which a signal output from the suppression filter 111 is input; a gain 703 which adaptively controls the gain of the signal that is output from the suppression filter 111 and input into the input terminal 702; a subtractor 704 which calculates a difference between the signal input into the input terminal 701 and the signal output from the gain 703; and an output terminal 705 which outputs the signal gain-controlled by the gain 703.

Next, an operation of the howling suppression device 300 according to the fifth embodiment will be described. Here, the gain 703 is a 1-tap adaptive filter, and the initial value is previously set, preferably to zero.

The signal from the A/D converter 102 is input into the input terminal 701. On the other hand, into the input terminal 702, the signal output from the suppression filter 111, that is, a signal from which the howling component included in the input signal is extracted is input. When assuming that the target signal is the signal that is input into the input terminal 701, the signal that is input into the input terminal 702 is input into the gain 703 as a reference signal.

In the gain control unit 601, the gain 703 multiplies each of sample values included in the reference signal by a gain value (that is, the filter coefficient of the adaptive filter), and the subtractor 704 subtracts, from the target signal, the signal output from the gain 703, so as to calculate an error signal.

The gain value of the gain 703 is adaptively updated so that the mean square of the error signal is smallest. The mean square error is smallest when the gain 703 outputs a signal having the amplitude of the howling component included in the input signal. As a result, the gain of the signal output from the suppression filter 111 is automatically controlled in such a manner as to suppress only the howling component according to the amplitude of the howling component included in the input signal. As an algorithm for updating the coefficient of the gain 703, various types of known adaptive algorithms such as the normalized least mean square (NLMS) algorithm are used.

As a result, the gain 703 outputs a signal which is obtained by controlling the gain of the signal output from the suppression filter 111 according to the amplitude of the howling component included in the input signal.

The suppression filter 111 determines a frequency band of the howling component. However, since an amplitude of the howling component varies with time, the amplitude of the howling component detected based on the previous signal delayed by the delay unit 103 is likely to be different from the amplitude of the howling component included in the current input signal. Thus, it is possible to suppress the howling more appropriately by the gain control unit 601 adjusting the amplitude of the howling component output from the suppression filter 111.

As described above, the howling suppression device 300 according to the fifth embodiment can control the amount of howling to be suppressed by adaptively controlling the gain of the signal output from the suppression filter 111 for howling suppression according to the amplitude of the howling component included in the input signal, and can also reduce gain loss in frequency characteristics of the processed sound involved in the howling suppression processing.

Embodiment 6

Figure 9:
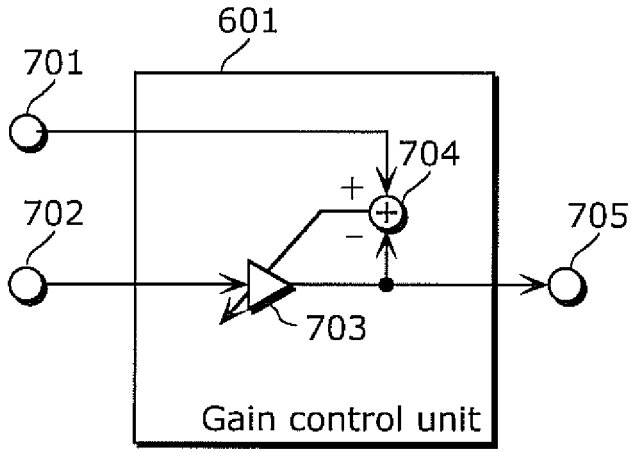
FIG. 9 is a block diagram of a gain control unit included in the howling suppression device according to the fifth embodiment of the present invention.
Figure 10:
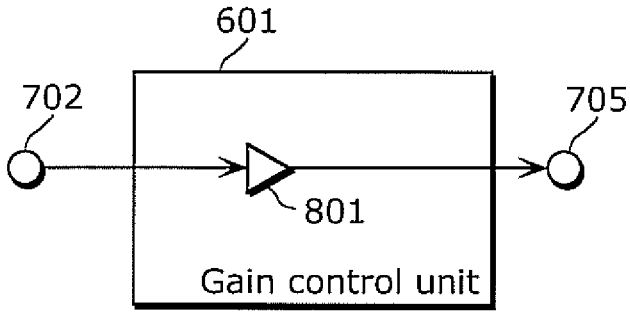
FIG. 10 is a block diagram of a gain control unit according to a sixth embodiment of the present invention.

FIG. 10 is a block diagram showing a configuration of a gain control unit 601 in the howling suppression device 300 according to a sixth embodiment of the present invention. Note that in FIG. 10, the same reference signs are used for the same constituent elements in FIG. 9, and the descriptions thereof are omitted.

In FIG. 10, the howling suppression device 300 according to the sixth embodiment includes a gain 801 which controls a gain of the signal that is output from the suppression filter 111 and input into the input terminal 702.

Next, an operation of the howling suppression device 300 according to the sixth embodiment will be described.

The signal which is output from the suppression filter 111 and then input into the input terminal 702 is multiplied by the gain value by the gain 801, to be output at the output terminal 705. Here, by setting the gain value of the gain 801 to below 1.0, the gain of the signal output from the suppression filter 111 is decreased. This corresponds to subtracting, by the subtractor 112, a smaller amount of the signal output from the suppression filter 111 from the signal input from the A/D converter 102, that is, reducing the amount of howling to be suppressed.

As described above, the howling suppression device 300 according to the sixth embodiment can control the amount of howling to be suppressed by controlling, using the fixed gain, the gain of the signal output from the howling-suppression filter.

Note that the gain value below 1.0 has been described as being set for the gain 801 in the sixth embodiment, but a gain value equal to or above 1.0 may be set for the gain 801 when it is intended to increase the amount of howling to be suppressed.

Embodiment 7

Figure 11:
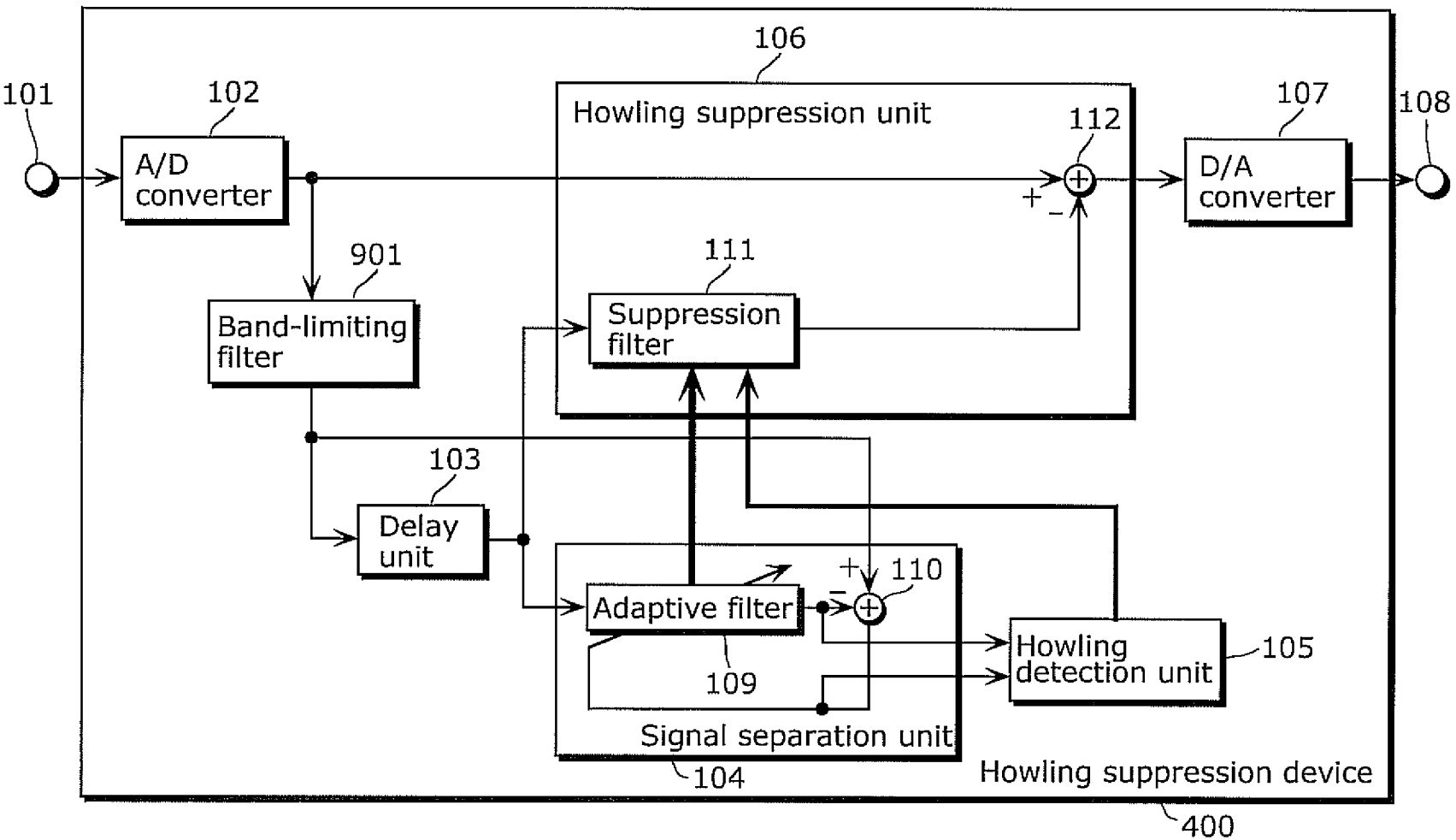
FIG. 11 is a block diagram of a howling suppression device according to a seventh embodiment of the present invention.
Figure 12:
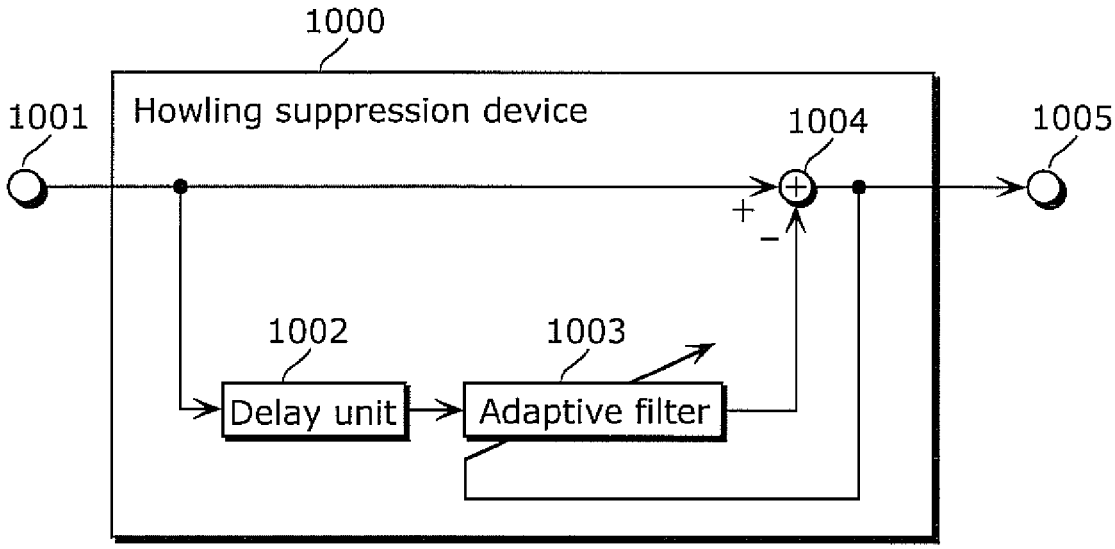
FIG. 12 is a block diagram of a conventional howling suppression device.

FIG. 11 is a block diagram of a howling suppression device 400 according to a seventh embodiment of the present invention. Note that in FIG. 11, the same reference signs are used for the same constituent elements in FIG. 1, and the descriptions thereof are omitted.

In FIG. 11, the howling suppression device 400 according to the seventh embodiment includes a band-limiting filter 901 which limits a band of the signal output from the A/D converter 102.

Next, an operation of the howling suppression device 400 according to the seventh embodiment will be described.

The band-limiting filter 901 limits the band of the signal output from the A/D converter 102, and passes only the band at which howling is expected to occur (for example, only middle- and high-pass ranges) so as to use the band for the subsequent howling detection processing and howling suppression processing. Here, as the band-limiting filter, a known filter such as a low-pass filter, a high-pass filter, and a band-pass filter is used. The band at which the howling is expected to occur can be considered to be, for example, a band of 1 kHz to 8 kHz.

As described above, the howling suppression device 400 according to the seventh embodiment can improve extraction accuracy of the howling component in the adaptive filter by performing, in the processing, band limitation on the band at which the howling is expected to occur.

Note that the use of the howling suppression devices 100, 200, 300, and 400 according to the respective embodiments described above is not particularly limited, but these devices are incorporated in, for example, a hearing aid or a karaoke apparatus.

(Other Variation)

Note that the present invention has thus far been described based on the embodiments above, but it goes without saying that the present invention is not limited to these embodiments. The following case is also included in the present invention.

(1) Part or All of the constituent elements included in each of the devices may be configured with system large scale integration (LSI). The system LSI is super-multifunctional LSI manufactured by integrating components on a single chip, and specifically is a computer system including a microprocessor, a ROM, a RAM, or the like. In the RAM, a computer program is stored. The system LSI fulfills its function with the microprocessor operating in accordance with the computer program.

(2) Part or all of the constituent elements included in each of the devices may be configured with a detachable Integrated Circuit (IC) card or a single module that is to be provided in each of the devices. The IC card or module is a computer system including a microprocessor, a ROM, a RAM, or the like. The IC card or module may include the super-multifunctional LSI described above. The IC card or module fulfills its function with the microprocessor operating in accordance with the computer program. The IC card or module may be tamper resistant.

(3) The present invention may also be realized as the methods described above. In addition, the present invention may be realized as a computer program causing a computer to execute these methods or as a digital signal including the computer program.

In addition, the present invention may be realized as the computer program or digital signal that is recorded on a computer readable recording medium, for example, a flexible disc, a hard disc, a CD-ROM, an MO, a DVD, a DVD-ROM, a DVD-RAM, a Blu-ray Disc (BD), and a semiconductor memory. In addition, the digital signal may be recorded on such recording media.

In addition, the present invention may be realized as the computer program or digital signal that is transmitted via a telecommunications line, a wireless or wired line, a network represented by the Internet, data broadcasting, and so on.

In addition, the present invention may be realized as a computer system including a microprocessor and a memory, with the memory storing the computer program and the microprocessor operating in accordance with the computer program.

In addition, the program or digital signal may be executed by another independent computer system, with the program or digital signal recorded and transported on a recording media or such program or digital signal transported via the network and so on.

(4) The above embodiments and variations may be combined with each other.

INDUSTRIAL APPLICABILITY

A howling suppression device according to the present invention produces an advantageous effect of effectively suppressing howling in an acoustic feedback loop environment and reducing quality deterioration of processed sound, and is useful as a howling suppression device or the like which suppresses, in various electroacoustic apparatuses which include a microphone and a speaker, howling which is caused by acoustic coupling that occurs between the speaker and the microphone.

REFERENCE SIGNS LIST

100, 200, 300, 400, 1000 Howling suppression device
101, 201, 202, 701, 702, 1001 Input terminal
102 A/D converter
103, 1002 Delay unit
104 Signal separation unit
105 Howling detection unit
106 Howling suppression unit
107 D/A converter
108, 207, 705, 1005 Output terminal
109, 1003 Adaptive filter
110, 112, 502, 704, 1004 Subtractor
111, 501 Suppression filter
203, 204 Level calculation unit
205 Level ratio calculation unit
206, 302, 403 Howling determination unit
301 Level change analysis unit
401 Band division unit
402 Band level calculation unit
601 Gain control unit
703, 801 Gain
901 Band-limiting filter

The invention claimed is:

1. A howling suppression device which suppresses a howling component included in an input signal, said howling suppression device comprising:

a delay unit which delays the input signal so as to output the delayed input signal as a reference signal;

a signal separation unit including an adaptive filter which extracts a periodic signal component from the reference signal according to an adaptively updated filter coefficient that is adaptively updated by said adaptive filter;

a howling detection unit configured to detect an occurrence of howling using at least a signal of the periodic signal component output from said adaptive filter; and a howling suppression unit including:

a first suppression filter which (i) obtains, according to timing based on when said howling detection unit detects the occurrence of the howling, the filter coefficient according to which said adaptive filter extracts the periodic signal component at a point in time when said howling detection unit detects the occurrence of the howling, and (ii) extracts the periodic signal component from the reference signal based on the obtained filter coefficient; and a first subtractor which subtracts the periodic signal component extracted by said first suppression filter from the input signal so as to output a signal obtained by the subtraction.

2. The howling suppression device according to claim 1, wherein said signal separation unit further includes a second subtractor which subtracts the periodic signal component output from said adaptive filter from the input signal so as to output an aperiodic signal component obtained by the subtraction, wherein said adaptive filter updates the filter coefficient such that a mean square of the aperiodic signal component output from said second subtractor is smallest, and wherein said first suppression filter obtains the updated filter coefficient from said adaptive filter when said howling detection unit detects the occurrence of the howling.

3. The howling suppression device according to claim 2, wherein said howling detection unit includes:

a first level calculation unit configured to calculate a signal level of the periodic signal component output from said adaptive filter;

a second level calculation unit configured to calculate a signal level of the aperiodic signal component output from said second subtractor;

a level ratio calculation unit configured to calculate a relative level ratio between the signal level output from said first level calculation unit and the signal level output from said second level calculation unit; and a howling determination unit configured to determine that the howling has occurred when the relative level ratio calculated by said level ratio calculation unit continues to be above a predetermined threshold for a predetermined period of time.

4. The howling suppression device according to claim 1, wherein said howling detection unit includes:

a level calculation unit configured to calculate a signal level of the periodic signal component output from said adaptive filter;

a level change analysis unit configured to analyze a time change of the signal level output from said level calculation unit; and a howling determination unit configured to determine that the howling has occurred when the signal level of the periodic signal component continues to increase with time for a predetermined period of time.

5. The howling suppression device according to claim 1, wherein said howling detection unit includes:

a band division unit configured to divide, into band signals, the signal of the periodic signal component output from said adaptive filter;

a band level calculation unit configured to calculate signal levels of the band signals output from said band division unit; and a howling determination unit configured to determine that the howling has occurred, when all of the calculated signal levels of at least one of the band signals are above a predetermined threshold, the signal levels being calculated during a predetermined period of time.

6. The howling suppression device according to claim 1, wherein said howling suppression unit further includes a second suppression filter which, when said howling detection unit detects the occurrence of the howling, obtains the filter coefficient currently held by said first suppression filter before said first suppression filter obtains another filter coefficient from said adaptive filter, and which extracts the periodic signal component from the reference signal based on the filter coefficient obtained from said first suppression filter, and wherein said first subtractor subtracts, from the input signal, the periodic signal components output from said first and second suppression filters, so as to output the signal obtained by the subtraction.

7. The howling suppression device according to claim 1, wherein said howling suppression unit includes a gain control unit configured to control a gain of the signal of the periodic signal component output from said first suppression filter.

8. The howling suppression device according to claim 7, wherein said gain control unit is configured to change the gain of the signal output from said first suppression filter according to an amplitude of the howling component included in the input signal.

9. The howling suppression device according to claim 7, wherein said gain control unit includes a fixed gain for adjusting an amount of howling to be suppressed.

10. The howling suppression device according to claim 1, further comprising a band-limiting filter which outputs, to said delay unit, only a signal of a band at which the howling is expected to occur, among bands of the input signal.

11. The howling suppression device according to claim 2, wherein, when said howling detection unit detects the occurrence of the howling, said adaptive filter resets the filter coefficient currently held by said adaptive filter and recalculates the filter coefficient based on the reference signal output from said delay unit and the aperiodic signal component output from said second subtractor.

12. A howling suppression method of suppressing, via a howling suppression device, a howling component included in an input signal, said howling suppression method comprising:

delaying the input signal so as to output the delayed signal as a reference signal;

first processing including extracting a periodic signal component from the reference signal according to an adaptively updated filter coefficient that is adaptively updated by said first processing;

detecting an occurrence of howling using at least a signal of the periodic signal component output in said first processing; and second processing including:

obtaining, by a first suppression filter of the howling suppression device and according to timing based on when said detecting detects the occurrence of the howling, the filter coefficient according to which said first processing extracts the periodic signal component at a point in time when said detecting detects the occurrence of the howling;

extracting, by the first suppression filter, the periodic signal component from the reference signal based on the obtained filter coefficient; and subtracting the periodic signal component extracted by said second processing from the input signal so as to output a signal obtained by the subtraction.

13. A non-transitory computer-readable recording medium having a program recorded thereon, the program for suppressing a howling component included in an input signal, the program causing a computer to execute a method comprising:

delaying the input signal so as to output the delayed signal as a reference signal;

first processing including extracting a periodic signal component from the reference signal according to an adaptively updated filter coefficient that is adaptively updated by said first processing;

detecting an occurrence of howling using at least a signal of the periodic signal component output in said first processing; and second processing including:

obtaining, by a first suppression filter and according to timing based on when said detecting detects the occurrence of the howling, the filter coefficient according to which said first processing extracts the periodic signal component at a point in time when said detecting detects the occurrence of the howling;

extracting, by the first suppression filter, the periodic signal component from the reference signal based on the obtained filter coefficient; and subtracting the periodic signal component extracted by said second processing from the input signal so as to output a signal obtained by the subtraction.

14. An integrated circuit which suppresses a howling component included in an input signal, said integrated circuit comprising:

a delay unit which delays the input signal so as to output the delayed input signal as a reference signal;

a signal separation unit including an adaptive filter which extracts a periodic signal component from the reference signal according to an adaptively updated filter coefficient that is adaptively updated by said adaptive filter;

a howling detection unit configured to detect an occurrence of howling using at least a signal of the periodic signal component output from the adaptive filter; and a howling suppression unit including:

a first suppression filter which (i) obtains, according to timing based on when said howling detection unit detects the occurrence of the howling, the filter coefficient according to which said adaptive filter extracts the periodic signal component at a point in time when said howling detection unit detects the occurrence of the howling, and (ii) extracts the periodic signal component from the reference signal based on the obtained filter coefficient; and a subtractor which subtracts the periodic signal component extracted by said first suppression filter from the input signal so as to output a signal obtained by the subtraction.

* * * * *